United States Patent [19]

Jeffers

[11] Patent Number: 4,699,061

[45] Date of Patent: Oct. 13, 1987

[54] BINARY CHEMICAL WARHEAD

[75] Inventor: A. Eugene Jeffers, Kingsville, Md.

[73] Assignee: The United States of America as represented by the Secretary of the Army, Washington, D.C.

[21] Appl. No.: 405,679

[22] Filed: Aug. 6, 1982

[51] Int. Cl.[4] ..... F42B 13/46

[52] U.S. Cl. ..... 102/370; 102/477; 102/478

[58] Field of Search ..... 102/367, 368, 369, 370, 102/477, 478, 705, 364, 365; 422/165, 166, 236, 237; 366/167, 176

[56] References Cited

U.S. PATENT DOCUMENTS

| | | | |
|---|---|---|---|
| 2,416,362 | 2/1947 | Walker | 102/477 |
| 3,701,573 | 10/1972 | McQuistion | 102/477 |
| 3,711,115 | 1/1973 | Lohr | 102/367 |
| 4,383,485 | 5/1983 | Coates et al. | 102/478 X |

FOREIGN PATENT DOCUMENTS

| | | | |
|---|---|---|---|
| 7580 | 3/1919 | United Kingdom | 102/364 |

OTHER PUBLICATIONS

"Chemical Warfare and Chemical Disarmament", *Scientific American,* Apr. 1980, pp. 38–47.

*Primary Examiner*—Deborah L. Kyle
*Assistant Examiner*—Ted L. Parr
*Attorney, Agent, or Firm*—Anthony T. Lane; Harold H. Card, Jr.

[57] ABSTRACT

Hardware and method are disclosed for mixing at least two non-toxic chemical compounds in a warhead for missiles and artillery projectiles to form a toxic agent during their ballistic travel to a target. The inventive design avoids danger from spills of toxic agent during shipment, handling or storage of chemical ammunition by not allowing the constituents of such agent to mix until shortly before the ammunition impacts the targets.

4 Claims, 4 Drawing Figures

BINARY CHEMICAL WARHEAD

GOVERNMENTAL INTEREST

The invention described herein may be manufactured, used and licensed by or for the Government for governmental purposes without the payment to me of any royalties thereon.

BACKGROUND OF THE INVENTION

Public laws have for over ten years prohibited certain test and manufacturing operations to be performed in the United States relating to chemical warfare agents. To avoid the total abandonment of progress in modern chemical weaponry, at the risk of allowing potential enemy forces to confront the world with a future threat of superiority in this technology which the United States might be unable to meet or counter, binary weapon systems have been adopted as a reasonable alternative.

The binary technique involves the design of missile or projectile warheads so as to accommodate two or more non-toxic chemicals or reagents which, when mixed together, combine to form a lethal or toxic agent. These reagents are separately contained in isolation from each other within the warhead until it is fired in combat. However, since many warheads are relatively small, as little as 8 inches in diameter, mixing mechanisms must be commensurately small in size to fit within such warheads. In addition, the time available for mixing during traverse of the warhead from gun muzzle to target is so brief that mixing must be extremely rapid. Moreover, since any unmixed portions of the reagent are harmless and ineffective against enemy targets, it follows that the mixing must be 100 percent complete before target impact or burst. These three major constraints of small space, brief time, and maximum efficiency in combining the reagents, produce a serious design challenge which the invention in this case addresses with most remarkable success.

BRIEF SUMMARY OF THE INVENTION

The invention in this case comprises a first container holding one of two principal reagents in a chemical warhead. The second reagent is contained within an injector assembly having a plurality of elongate spray tubes with holes along their length and a piston for exerting force against the second reagent. Upon actuation of a gas generator, gas pressure applied to the piston causes its movement against the second reagent, forcing it into the spray tubes and out of the holes, whereby the second reagent is forcibly and rapidly sprayed into the first reagent to achieve a complete reaction between the two, thus producing a toxic agent within the warhead just prior to its impact or detonation at the enemy target.

DETAILED DESCRIPTION OF THE PREFERRED EMBODIMENT

Figure 1:
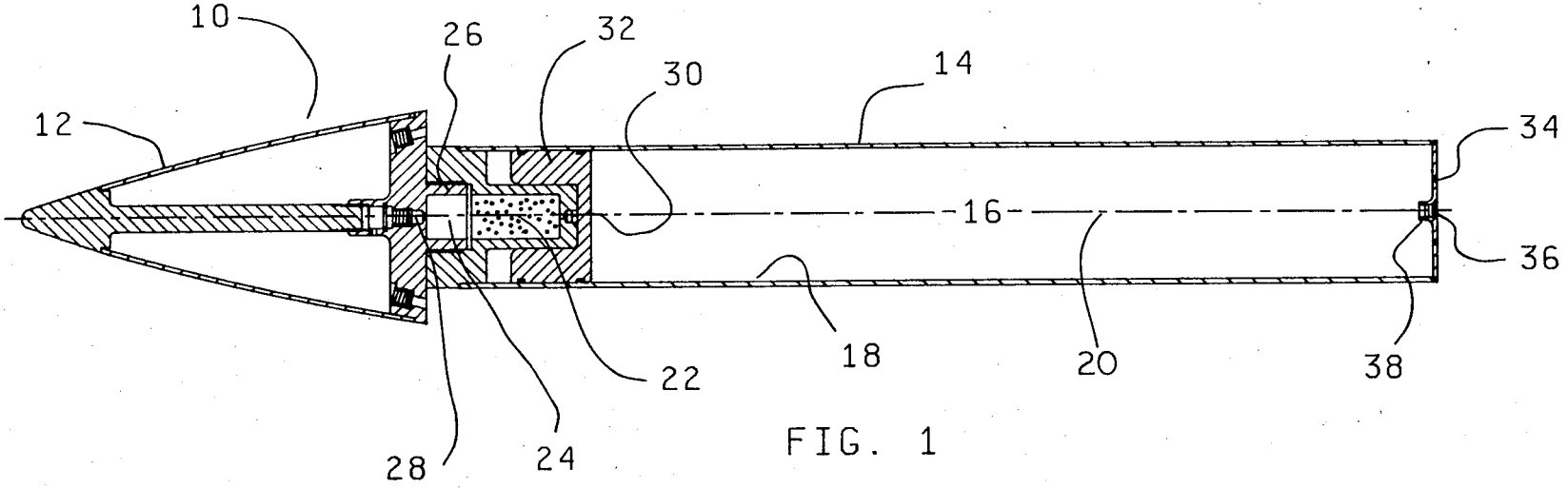
FIG. 1 shows an isolated cross-sectional view through a first principal component of a warhead incorporating the inventive principles of this case.

FIG. 1 shows a first warhead component generally designated by reference numeral 10 and comprising a forward nose cone or ogive section 12 structurally affixed to an elongate cylindrical housing or canister 14. Closed housing 14 contains a first fluid reagent 16 within rigid wall surface 18 which is symmetrical about a center longitudinal axis 20 through housing 14 and warhead component 10. Operatively related to nose section 12 is gas generator propellant material illustratively comprising combustion chamber 22 and a cup or holder 26 with which igniter means 28 communicates. Gas pressure within chamber 22 applies force to a closure means in chamber 22 such as diaphragm or rupture disc 30. After the disc ruptures, gas from chamber 22 escapes therefrom and applies force to a pressure transmittal means, such as piston 32 which is translationally slidable within housing 14 and in close, intimate, uniform peripheral contact with surface 18 thereof. The gas pressure causes piston 32 to move laterally within housing 14 from the forward end thereof shown in FIG. 1 throughout its length to the aftmost end 34 thereof. The noted movement of piston 32 cannot occur without displacement of the reagent 16 which occurs after the pressure transmitted by the piston to the reagent builds up sufficiently to cause rupturing of a second diaphragm or rupture disc 36 or other suitable closure means situated in a passage 38 at the aft end 34 remote from the forward end of housing 14.

Figure 2:
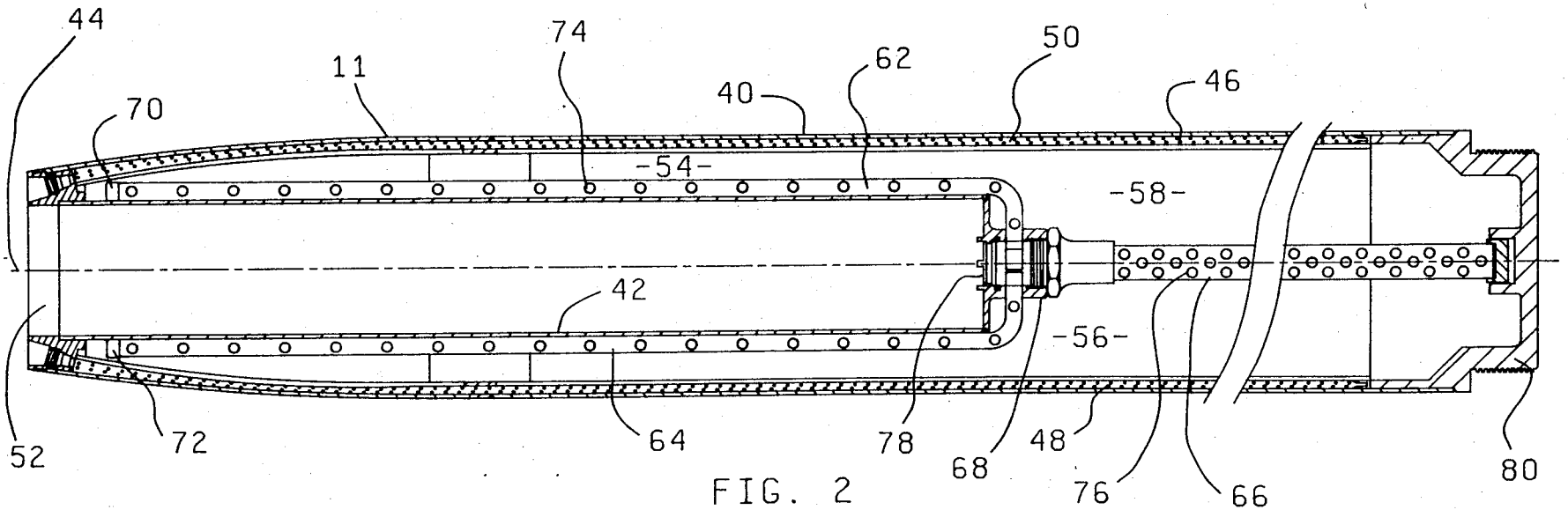
FIG. 2 shows an isolated cross-sectional view through second principal components of the warhead to which FIG. 1 relates.
Figure 3:
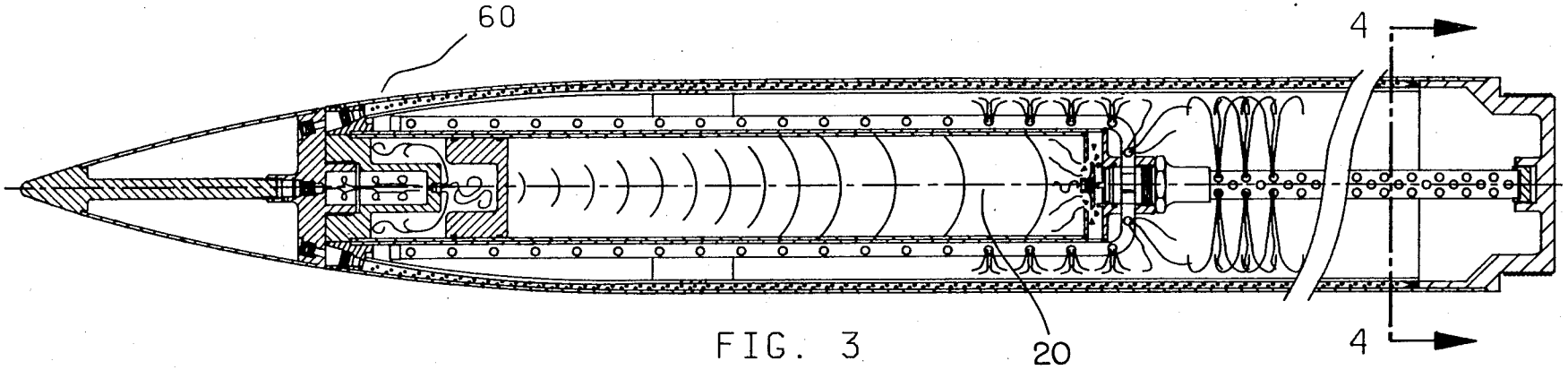
FIG. 3 shows a side elevational view, partly in cross-section, of a warhead with the two components of FIGS. 1 and 2 assembled in operative interrelaionship.
Figure 4:
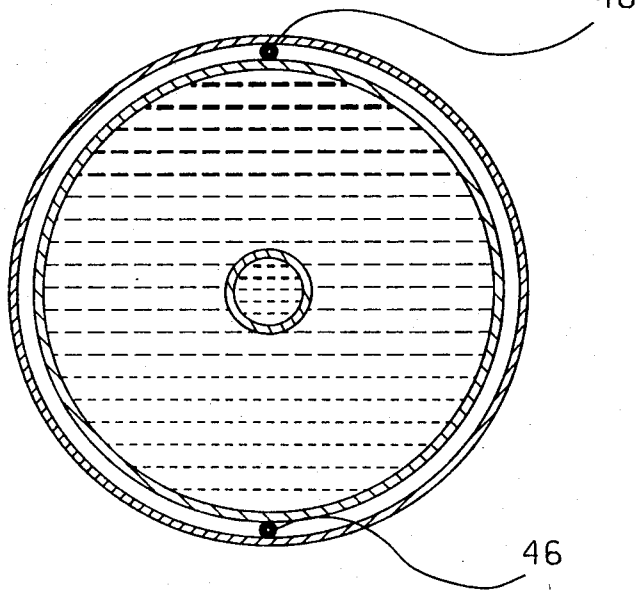
FIG. 4 is a vertical sectional view taken on the line 4—4 of FIG. 3.

Referring to FIG. 2, a second major warhead component generally designated by numeral 11 is seen to comprise in essence two substantially concentric elongate, preferably cylindrical, hollow housings 40 and 42 symmetrical about a center longitudinal axis 44. Outer housing 40 supports two spaced-apart explosive conduits 46 and 48, respectively. Housing 40 has a circular opening at its forward end as defined by a rigid ring or annular seat 52 affixed to inner hollow housing 42. The housing 42 is substantially shorter than outer housing 40 and is separated therefrom by an annular space 54 which communicates with space 56. Both spaces 54 and 56 are filled with a second reagent 58 which is completely self-contained between housings 40 and 42, and the assembly thus depicted in FIG. 1 is generally referred to as the injector system for the assembled warhead 60 shown in FIG. 3.

The warhead section of FIG. 2 includes a plurality of spray tubes as suggested by hollow elongate tubes 62, 64 and 66. All three of these tubes communicate with a common manifold or dispersing chamber 68 and all three tubes are capped or otherwise closed off at their distal extremeties as suggested by caps 70 and 72 on tubes 62 and 64, respectively. Moreover, all three tubes are provided with spaced-apart apertures along their length as suggested by apertures 74 and 76 in FIG. 2. Also, chamber 68 has an openable forward end which is normally closed and isolated from the interior of housing 42 by a rupture disc 78 while housing 40 is closed at its forward end by ring 52 and by a cap or closure member 80 at its aft end.

OPERATION

In operation, the components shown in FIGS. 1 and 2 are first assembled in the relationship seen from FIG.

3. This assembly does not occur until these components have been shipped and delivered to a location of combat with enemy troops or attack on enemy targets. At such location, inert component 10 is joined to element 11 by inserting housing 14 into housing 42 which is sized to fit in close uniform nesting relationship around element 14. The principal components are then locked together firmly prior to firing or launch.

Upon launching, a timed fuze (not shown) within warhead nose cone 12 activates after 2 seconds from launch to provide a first stage signal to gas propellant cup 26 to activate igniter 28 causing combustion of propellant 22. Pressure from the combustion gas within chamber 22 then immediately ruptures disc 30 and applies force to piston 32 which transmits force into reagent 16 causing the reagent to rupture disc 36.

Rupture of disc 36 allows first reagent 16 to quickly escape through passage 38 and opening 78 into chamber 68 and, hence, into tubes 62, 64 and 66 wherefrom it sprays at high velocity through apertures 74 and 76 into second reagent 58, mixing rapidly and thoroughly therewith to form a toxic mix. When the warhead is at a predetermined location with reference to a target area, the warhead fuze in nose cone 12 activates a second stage operation by initiating a signal to cause detonation of an explosive within conduits 46 and 48 causing massive rupture of outer housing 40 whereby the toxic binary agent mixture 16, 58 is disseminated.

From FIG. 2 it may be seen that spray tubes 62, 64 and 66 are coextensive with the mass of reagent 58 and of compartment 40, 42 which contains the reagent 58. This results in a spray pattern which forcibly injects reagent 16 into reagent 58 uniformly at multiple locations throughout the mass 58 to achieve complete and esentially simultaneous mixing of both reagents in their entirety.

I claim:

1. In a binary chemical warhead for missiles and artillery projectiles:

a first closed compartment containing a mass of first reagent for mixing a toxic binary agent, a second closed compartment containing a second reagent for mixing with said first reagent, elongate hollow tubular means including a plurality of tubes perforated by multiple apertures and situated within said mass of first reagent, and pressure means operatively related to said tubular means for forcing said second reagent out of said second closed compartment into said tubes for spraying rapidly into said mass of first reagent to form a toxic binary chemical mixture.

2. The structure in claim 1, further including fuze means in said warhead for activating said pressure means to apply force on said second reagent.

3. The structure in claim 2, wherein:

said pressure means comprises a gas generator for generating gas pressure and a piston for transmitting said gas pressure to said second reagent.

4. The structure in claim 3, wherein:

said plurality of tubes are connected to a common manifold through which all of said second reagent passes, and said plurality of tubes are spaced-apart from each other and are coextensive with said first closed compartment so that said second reagent is forcibly sprayed at multiple locations uniformly throughout said mass of first reagent.

* * * * *